US012102237B2

(12) United States Patent
Wang et al.

(10) Patent No.: US 12,102,237 B2
(45) Date of Patent: Oct. 1, 2024

(54) INFLATABLE PRODUCT

(71) Applicant: Team Worldwide Corporation, Taipei (TW)

(72) Inventors: Cheng-Chung Wang, Taipei (TW); Chien-Hua Wang, Taipei (TW); Yao-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

(21) Appl. No.: 17/560,108

(22) Filed: Dec. 22, 2021

(65) Prior Publication Data

US 2022/0202199 A1 Jun. 30, 2022

Related U.S. Application Data

(60) Provisional application No. 63/132,649, filed on Dec. 31, 2020.

(51) Int. Cl.
*A47C 27/08* (2006.01)
*A47C 27/10* (2006.01)

(52) U.S. Cl.
CPC ..... *A47C 27/087* (2013.01); *A47C 27/081* (2013.01); *A47C 27/08* (2013.01); *A47C 27/10* (2013.01)

(58) Field of Classification Search
CPC ..... A47C 27/087; A47C 27/081; A47C 27/08; A47C 27/082; A47C 27/083; A47C 27/084; A47C 27/10; A61G 7/057; A61G 7/05746; A61G 7/05769; A61G 7/05776; A61G 7/05784; A61G 7/05792; Y10T 428/24744; Y10S 297/03
See application file for complete search history.

(56) References Cited

U.S. PATENT DOCUMENTS 654,430 A * 7/1900 Berger ..... A47C 27/081 24/114.3
811,406 A * 1/1906 Keil ..... A47C 27/081 24/114.12
1,610,898 A * 12/1926 Steiner ..... A47C 27/081 5/712
2,982,341 A * 5/1961 Besser ..... A47C 27/081 297/DIG. 3
4,004,380 A * 1/1977 Kwake ..... E04H 15/20 D25/16

(Continued)

FOREIGN PATENT DOCUMENTS

CN 2812721 Y * 9/2006
CN 107283849 A * 10/2017 ..... B29C 65/02

*Primary Examiner* — David R Hare
*Assistant Examiner* — Deborah Talitha Gedeon

(57) ABSTRACT

An inflatable product includes an inflatable chamber and an elongated element. The inflatable chamber includes fusion portions. The elongated element is flexible, is disposed in the inflatable chamber, includes enlarged portions, and is connected to the inflatable chamber with the enlarged portions constrained by the fusion portions. The elongated element is in tension for controlling expansion of the inflatable chamber to a desired shape when the inflatable chamber is inflated to expand. The enlarged portions are constrained by the fusion portions to avoid separation of the elongated element from the inflatable chamber when the inflatable chamber is inflated to expand.

19 Claims, 14 Drawing Sheets

(56) References Cited

U.S. PATENT DOCUMENTS

| | | | | |
|---|---|---|---|---|
| 2006/0130240 | A1* | 6/2006 | Hsu | A47C 27/081 5/712 |
| 2006/0288489 | A1* | 12/2006 | Yang | A47C 27/081 5/711 |
| 2020/0187668 | A1* | 6/2020 | Ocegueda Gallaga | B29C 66/4722 |

* cited by examiner

INFLATABLE PRODUCT

CROSS REFERENCE TO RELATED APPLICATIONS

This application claims the benefit of U.S. Provisional Application No. 63/132,649, filed Dec. 31, 2020.

BACKGROUND OF THE INVENTION

Field of the Invention

The invention relates to an inflatable product with the durability thereof improved.

Description of the Related Art

An inflatable product (e.g. air mattress) may have straps inside. The straps are connected to inner surfaces of the inflatable product by fusion. When the inflatable product is inflated to expand, the straps sustain pulling forces for controlling expansion of the inflatable product to a desired shape.

However, the user can seldom expect a good durability of the inflatable product since an inflatable product is mostly manufactured by way of fusion. Damage to the inflatable product generally occurs at the fusion location after repeated inflation and deflation of the inflatable product.

BRIEF SUMMARY OF THE INVENTION

The invention provides an alternative means for connecting straps (or other elongated elements) to the inflatable product, in order to improve the durability thereof. The inflatable product in accordance with an exemplary embodiment of the invention includes an inflatable chamber and an elongated element. The inflatable chamber includes fusion portions. The elongated element is flexible, is disposed in the inflatable chamber, includes enlarged portions, and is connected to the inflatable chamber with the enlarged portions constrained by the fusion portions. The elongated element is in tension for controlling expansion of the inflatable chamber to a desired shape when the inflatable chamber is inflated to expand. The enlarged portions are constrained by the fusion portions to avoid separation of the elongated element from the inflatable chamber when the inflatable chamber is inflated to expand.

In another exemplary embodiment, the enlarged portions are knots.

In yet another exemplary embodiment, the enlarged portions are lumps or knobs in the elongated element.

In another exemplary embodiment, the enlarged portions are substances extending laterally from the elongated element.

In yet another exemplary embodiment the elongated element extends to pass between the fusion portions while the enlarged portions are disposed between the fusion portions, and the enlarged portions are forced against the fusion portions when the inflatable chamber is inflated so that the elongated element is in tension.

In another exemplary embodiment, the elongated element extends to pass between the fusion portions while the enlarged portions are disposed beside the fusion portions, and the enlarged portions are forced against the fusion portions when the inflatable chamber is inflated so that the elongated element is in tension.

In yet another exemplary embodiment, the elongated element extends to pass between the fusion portions while the enlarged portions are disposed at opposite sides of the fusion portions, and the enlarged portions are forced against the fusion portions when the inflatable chamber is inflated so that the elongated element is in tension.

In another exemplary embodiment, the inflatable product further includes first supplemental sheets disposed in the inflatable chamber and fused with the inflatable chamber to form the fusion portions and to cover the enlarged portions of the elongated element.

In yet another exemplary embodiment, the inflatable product further includes second supplemental sheets disposed outside or in the inflatable chamber and fused with the inflatable chamber and the first supplemental sheets.

In another exemplary embodiment, the enlarged portions are disposed between the first supplemental sheets and the second supplemental sheets.

In yet another exemplary embodiment, the inflatable product further includes first supplemental sheets disposed in the inflatable chamber and fused with the inflatable chamber to form the fusion portions, wherein the first supplemental sheets are disposed without covering the enlarged portions of the elongated element.

In another exemplary embodiment, the inflatable product further includes second supplemental sheets disposed outside or in the inflatable chamber and fused with the inflatable chamber and the first supplemental sheets.

In yet another exemplary embodiment, the inflatable chamber further includes a top wall, a bottom wall and a side wall connected to the top wall and the bottom wall, and the elongated element is connected to the top wall and the bottom wall.

In another exemplary embodiment, the inflatable chamber further includes a top wall, a bottom wall and a side wall connected to the top wall and the bottom wall, and the elongated element is connected to the top wall and the side wall.

In yet another exemplary embodiment, the inflatable chamber further includes a top wall, a bottom wall and a side wall connected to the top wall and the bottom wall, and the elongated element is connected to the bottom wall and the side wall.

In another exemplary embodiment, the elongated element extends in the inflatable chamber and curves alternately in opposite directions.

In yet another exemplary embodiment, the inflatable product further includes other elongated elements disposed in the inflatable chamber wherein all the elongated elements are arranged in a row or in an array.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
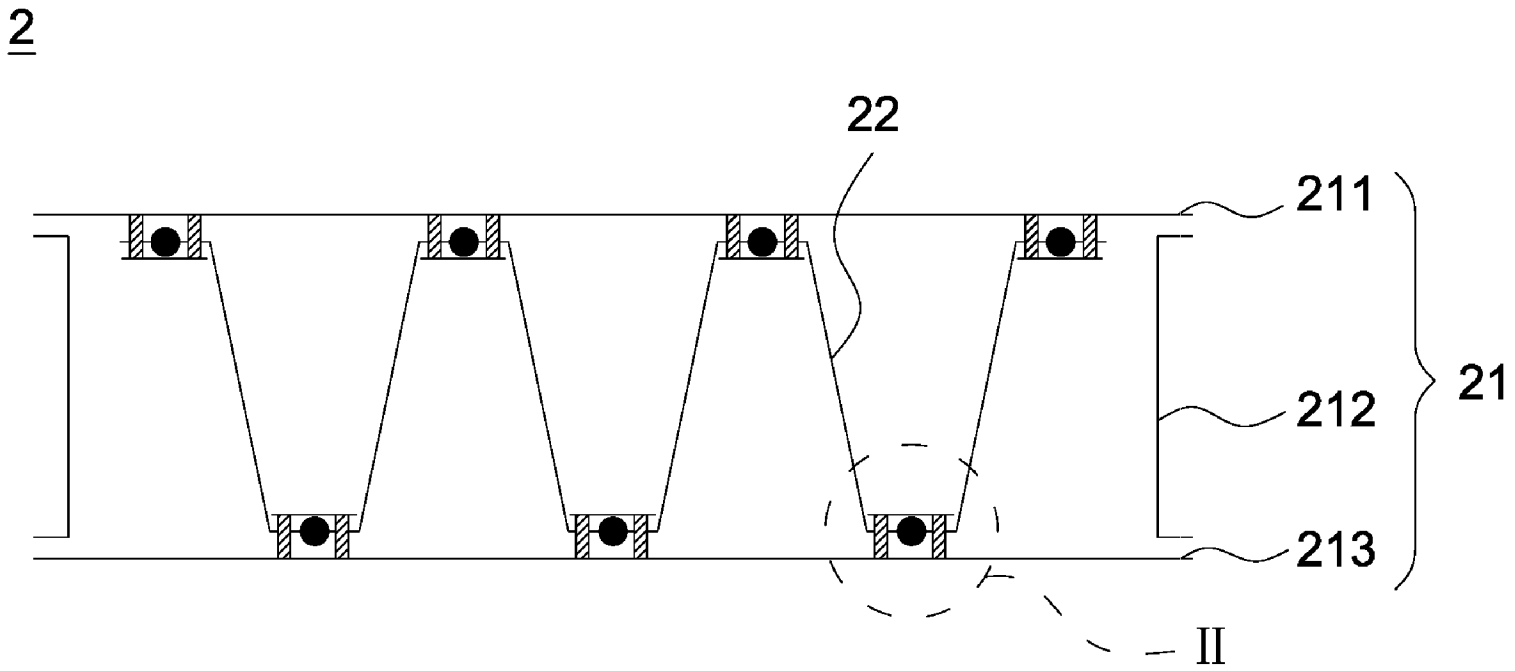
FIG. 1 is a sectional view of an inflatable product in accordance with a first embodiment of the invention.
Figure 2:
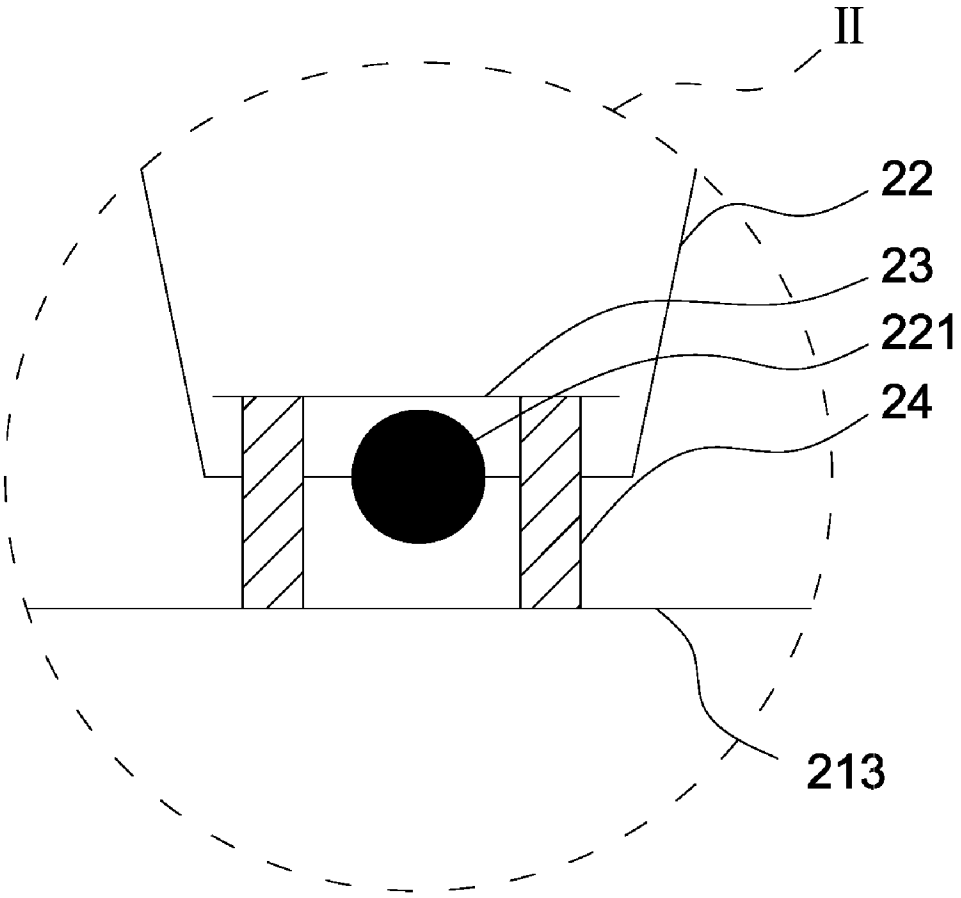
FIG. 2 is a local view of the inflatable product of FIG. 1.

Referring to FIGS. 1 and 2, an inflatable product 2 of a first embodiment of the invention includes an inflatable chamber 21 and an elongated element 22. The inflatable chamber 21 includes a top wall 211, a side wall 212 and a bottom wall 213. The elongated element 22 is flexible, is provided in the inflatable chamber 21 and is connected to the top wall 211 and the bottom wall 213. When the inflatable chamber 21 is inflated to expand, the stretch of the top wall 211 and the bottom wall 213 is limited by the elongated element 22 (under the pulling forces of the elongated element 22), thereby controlling expansion of the inflatable chamber 21 to a desired shape.

In the first embodiment, the elongated element 22 is a cord. The inflatable product 2 further includes first supplemental sheets 23 which are provided in the inflatable chamber 21 and are fused with the top and bottom walls 211, 213 of the inflatable chamber 21 to form fusion portions 24. The elongated element 22 has enlarged portions 221 and is connected to the top and bottom walls 211, 213 of the inflatable chamber 21 with the enlarged portions 221 covered with the first supplemental sheets 23 and constrained by the fusion portions 24.

Figure 3:
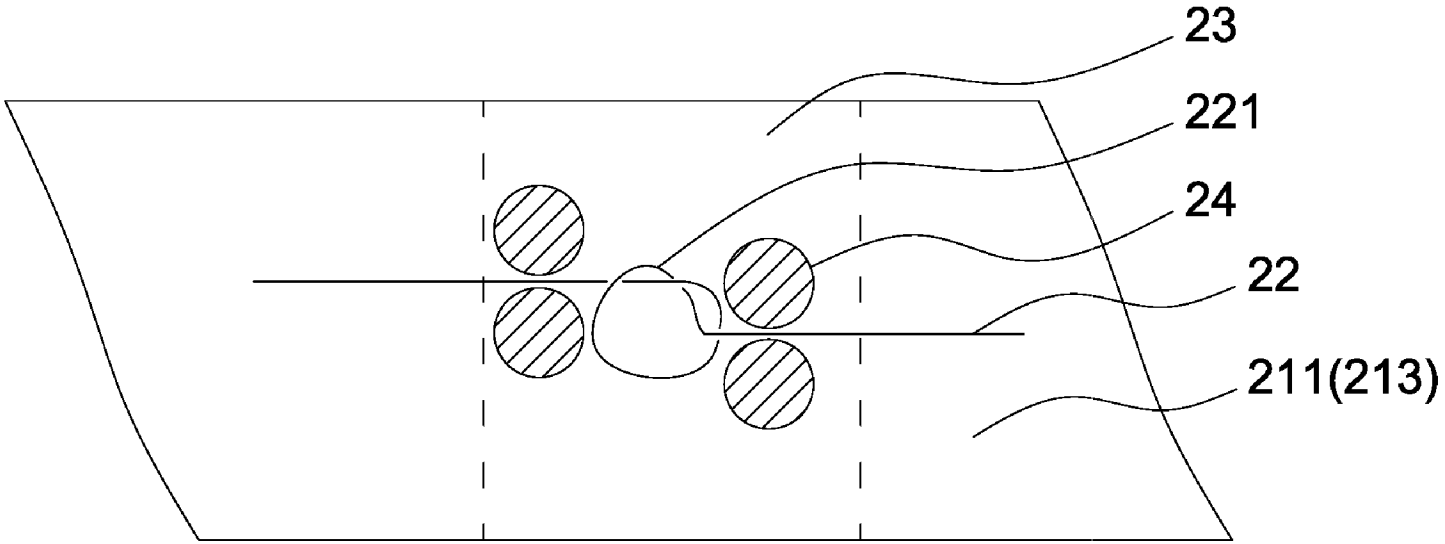
FIG. 3 is a top view of the air mattress of FIG. 2.

In the first embodiment, the enlarged portions 221 are knots. As shown in FIG. 3, the elongated element 22 extends to pass between the fusion portions 24 while the enlarged portions 221 are disposed between the fusion portions 24.

Referring back to FIG. 1, the elongated element 22 extends in the inflatable chamber 21 and curves alternately in opposite directions to be wavy. When the inflatable chamber 21 is inflated to expand, the elongated element 22 is in tension and the enlarged portions 221 are forced against the fusion portions 24. The arrangement that the enlarged portions 221 are constrained by the fusion portions 24 is able to avoid separation of the elongated element 22 from the inflatable chamber 21.

Figure 5:
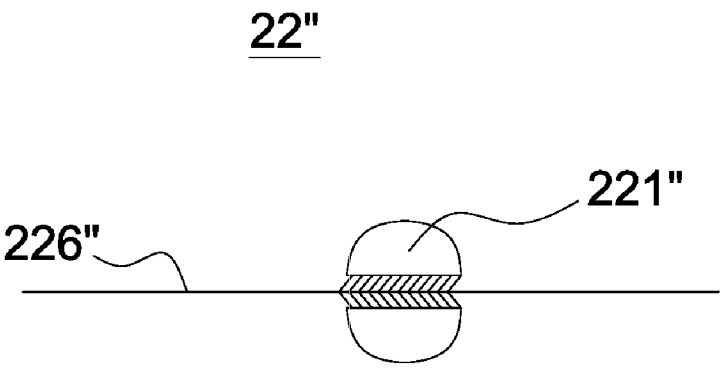
FIG. 5 depicts another modified elongated element of the inflatable product of the first embodiment.
Figure 4:
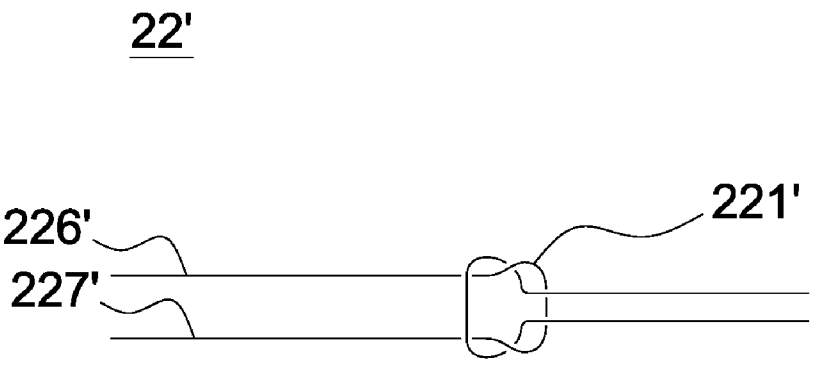
FIG. 4 depicts a modified elongated element of the inflatable product of the first embodiment.

In the first embodiment, the elongated element 22 is a cord. However, the invention is not limited thereto. The elongated element 22 can be replaced with another elongated element 22' as shown in FIG. 4, wherein the elongated element 22' includes a plurality of cords 226', 227' with knots 221' formed therein. Alternatively, the elongated element 22' can be replaced with another elongated element 22" as shown in FIG. 5, wherein the elongated element 22" includes a cord 226" with a lump(s) or a knob(s) 221" attached thereto. The lump(s) or knob(s) can be formed by sewing, injection molding and so on. In the invention, the elongated element may be a line(s), a thread(s), a cord(s), a string(s), a rope(s), a twine(s), a strip(s), a strap(s), a ribbon(s), a band(s) or the like. The enlarged portions may be any substances extending laterally from the elongated element so as to avoid separation of the elongated element from the inflatable chamber when the inflatable product is inflated. Those will not be repeatedly emphasized in the following description.

Figure 6:
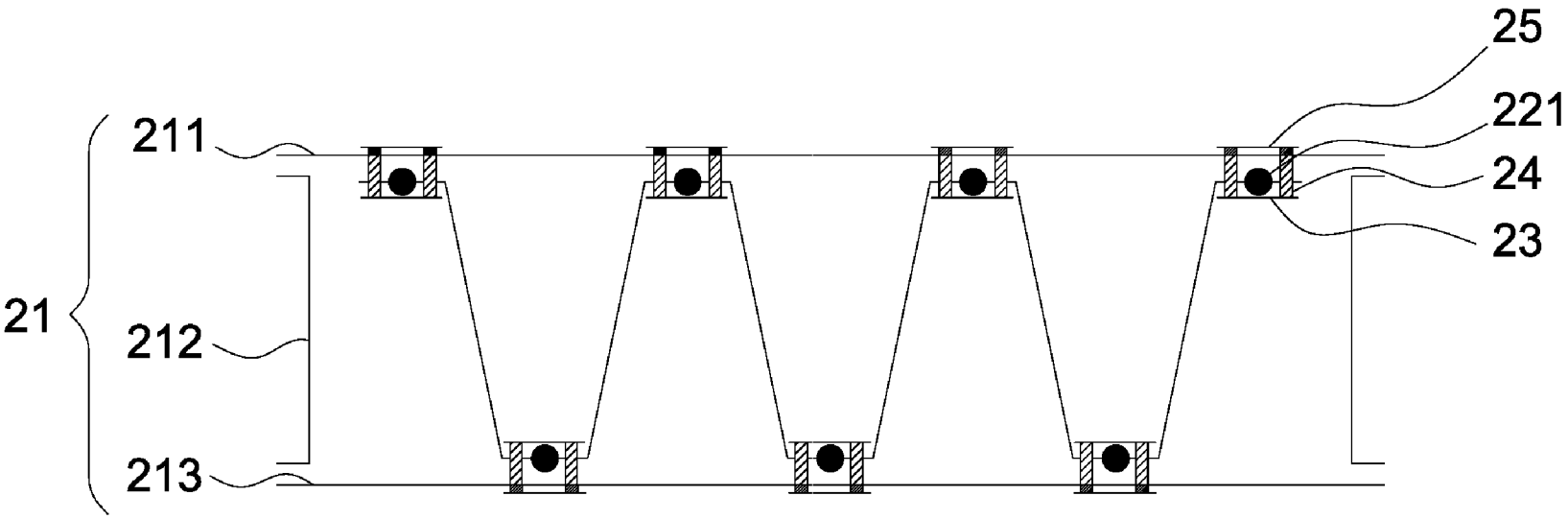
FIG. 6 is a sectional view of an inflatable product in accordance with a second embodiment of the invention.

Referring to FIG. 6, in a second embodiment, the inflatable product further includes second supplemental sheets 25 disposed outside the inflatable chamber 21 and fused with the inflatable chamber 21 and the first supplemental sheets 23 to enhance the structural strengths of the fusion portions 24, wherein the enlarged portions 221 are disposed between the first supplemental sheets 23 and the second supplemental sheets 25. Other structure and arrangements of this embodiment are identical to those of the first embodiment and therefore the descriptions thereof are omitted.

In the second embodiment, the second supplemental sheets 25 are disposed outside the inflatable chamber 21. However, the invention is not limited thereto. For example, the second supplemental sheets 25 can be disposed in the inflatable chamber 21 to respectively contact the top wall 211 and the bottom wall 213, so that the enlarged portions 221 are still disposed between the first supplemental sheets 23 and the second supplemental sheets 25. The second supplemental sheets 25 are fused with the inflatable chamber 21 and the first supplemental sheets 23 to enhance the structural strengths of the fusion portions 24.

Figure 7:
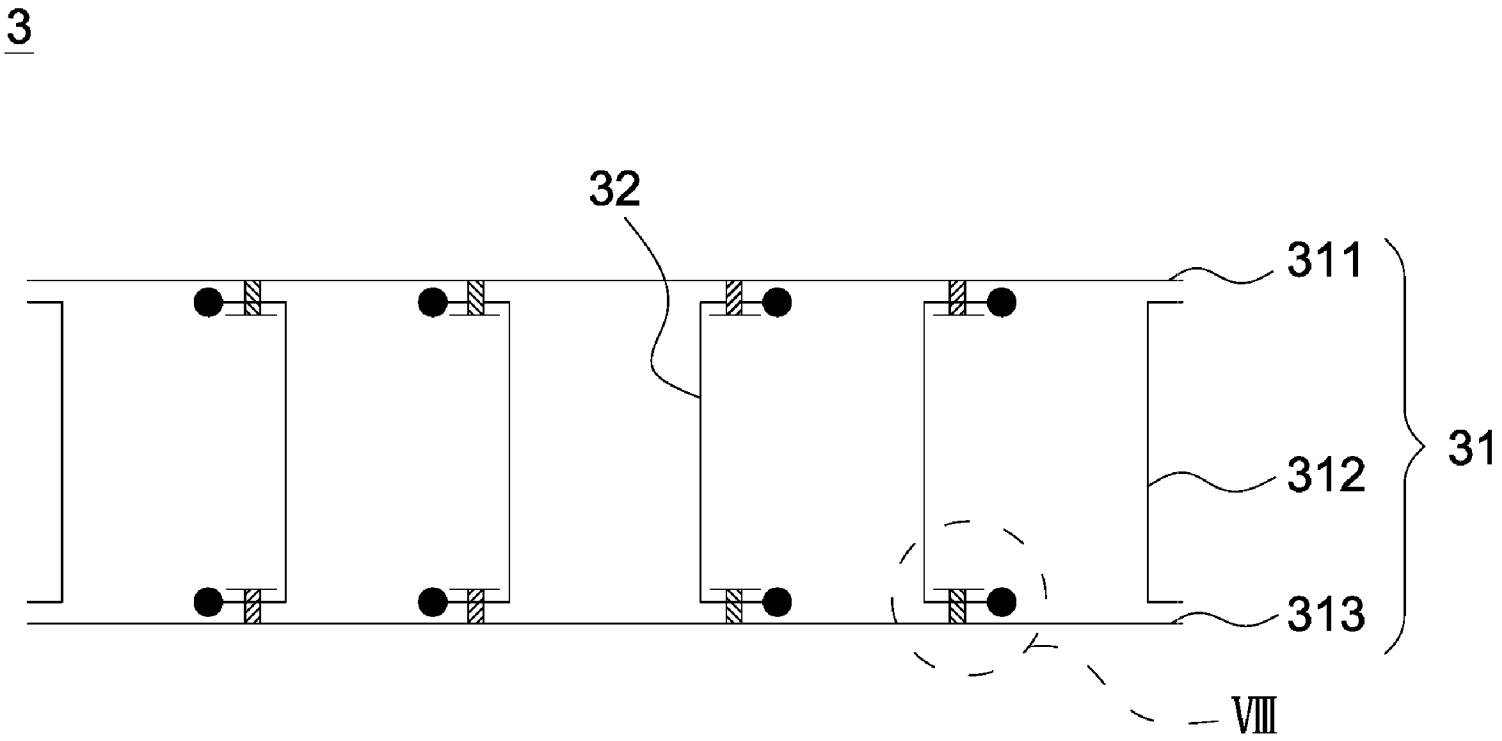
FIG. 7 is a sectional view of an inflatable product in accordance with a third embodiment of the invention.
Figure 8:
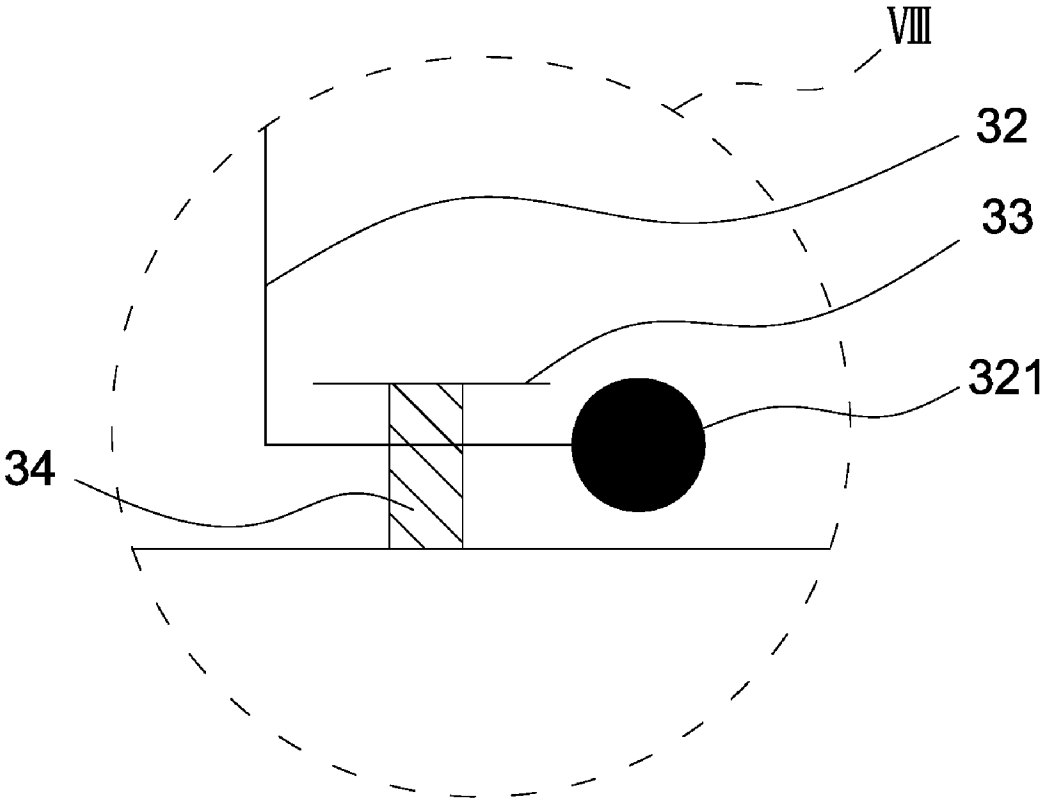
FIG. 8 is a local view of the inflatable product of FIG. 7.

Referring to FIGS. 7 and 8, an inflatable product 3 of a third embodiment of the invention includes an inflatable chamber 31 and elongated elements 32. The inflatable chamber 31 includes a top wall 311, a side wall 312 and a bottom wall 313. The elongated elements 32 are connected to the top wall 311 and the bottom wall 313, and are arranged in a row or in an array. All the elongated elements 32 are substantially perpendicular to the top wall 311 and the bottom wall 313 when the inflatable chamber 31 is inflated to expand so that all the elongated elements 32 are in tension.

Further, the elongated elements 32 have enlarged portions 321. The inflatable product 3 further includes first supplemental sheets 33 disposed in the inflatable chamber 31 and fused with the inflatable chamber 31 to form fusion portions 34. The elongated elements 32 are connected to the top wall 311 and the bottom wall 312 with the enlarged portions 321 constrained by the fusion portions 34. The first supplemental sheets 33 are disposed to partially cover the elongated elements 32 but not to cover the enlarged portions 321 of the elongated elements 32.

Figure 9:
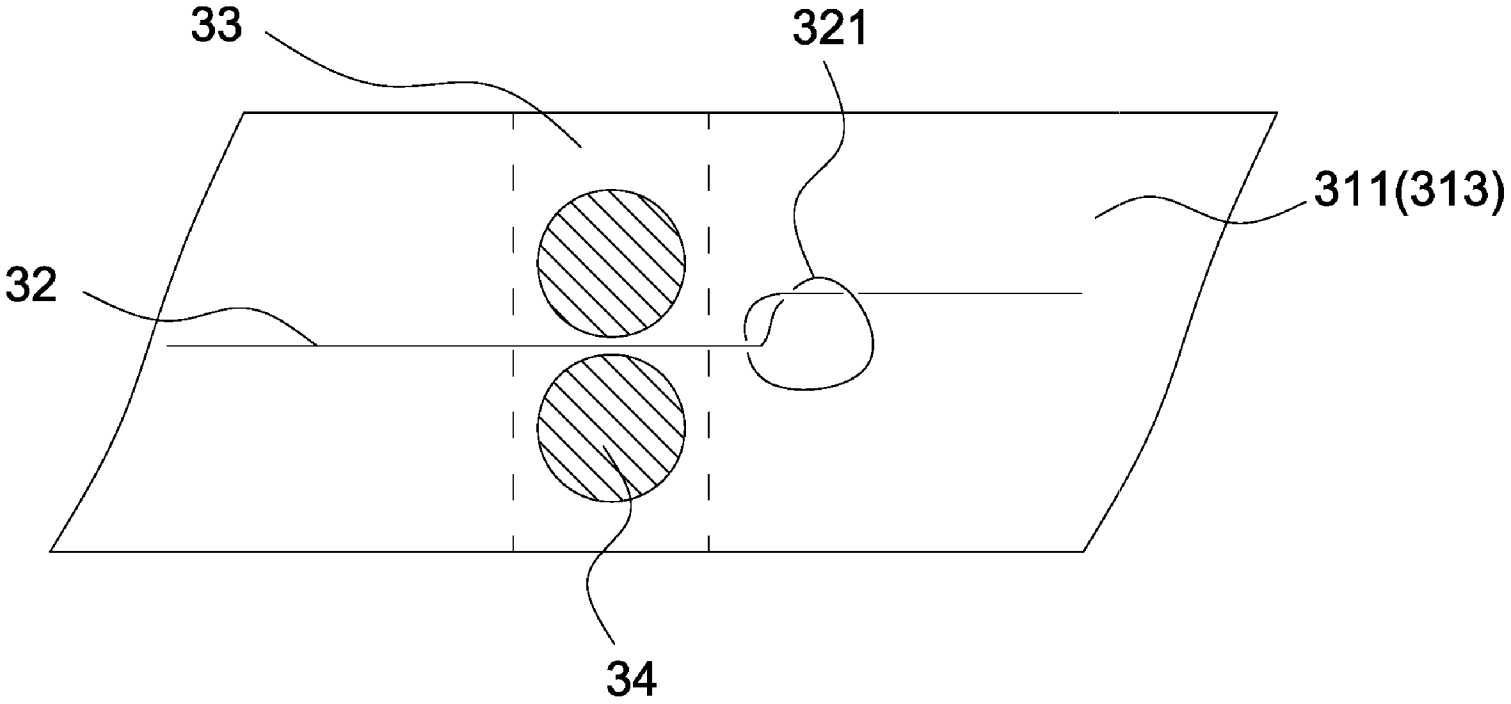
FIG. 9 is a top view of the air mattress of FIG. 8.

As shown in FIG. 9, the elongated elements 32 extend to pass between the fusion portions 34 while the enlarged portions 321 are disposed beside the fusion portions 34. When the inflatable chamber 3 is inflated to expand, the elongated elements 32 are in tension and the enlarged portions 321 are forced against the fusion portions 34 so as to avoid separation of the elongated element 32 from the inflatable chamber 31.

Figure 10:
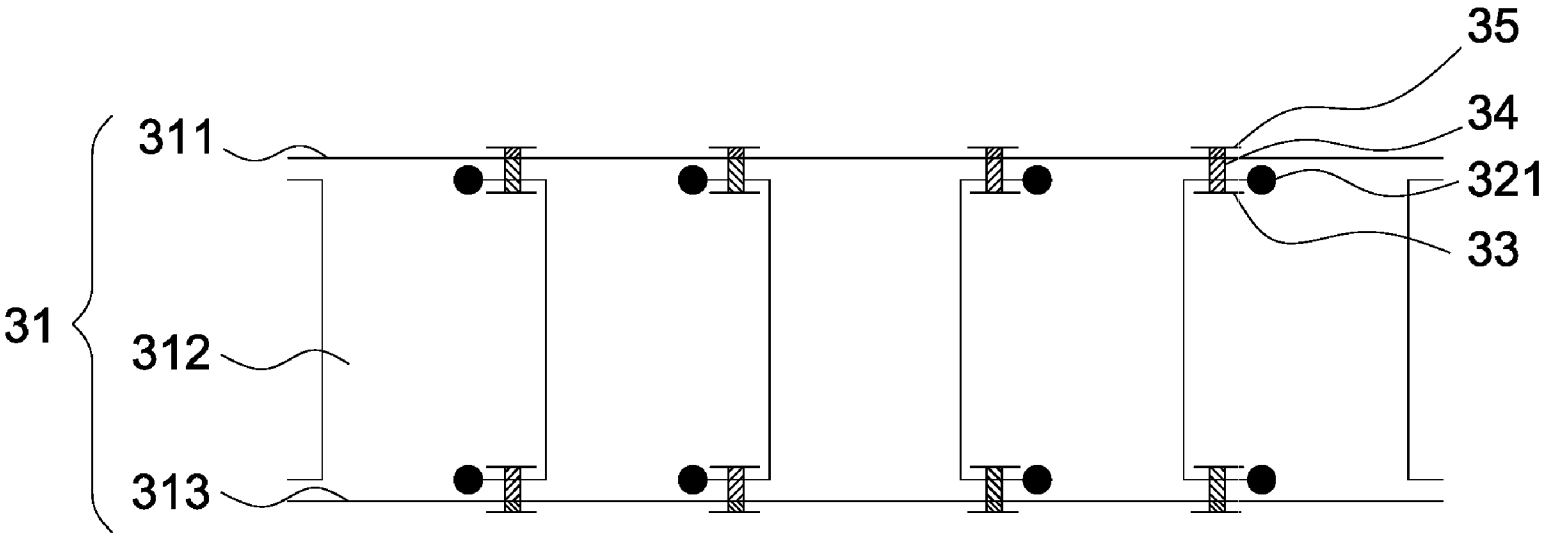
FIG. 10 is a sectional view of an inflatable product in accordance with a fourth embodiment of the invention.

Referring to FIG. 10, in a fourth embodiment, the inflatable product further includes second supplemental sheets 35 disposed outside the inflatable chamber 31 and fused with the inflatable chamber 31 and the first supplemental sheets 33 to enhance the structural strengths of the fusion portions 34. Other structure and arrangements of this embodiment are identical to those of the third embodiment and therefore the descriptions thereof are omitted.

In the fourth embodiment, the second supplemental sheets 35 are disposed outside the inflatable chamber 31. However, the invention is not limited thereto. For example, the second supplemental sheets 35 can be disposed in the inflatable chamber 31 to respectively contact the top wall 311 and the bottom wall 313, wherein the second supplemental sheets 35 are disposed between the first supplemental sheets 33 and the inflatable chamber 31, and the enlarged portions 321 of the elongated elements 32 are not covered with the first supplemental sheets 33 and the second supplemental sheets 35. The second supplemental sheets 35 are fused with the inflatable chamber 31 and the first supplemental sheets 33 to enhance the structural strengths of the fusion portions 34.

Figure 11:
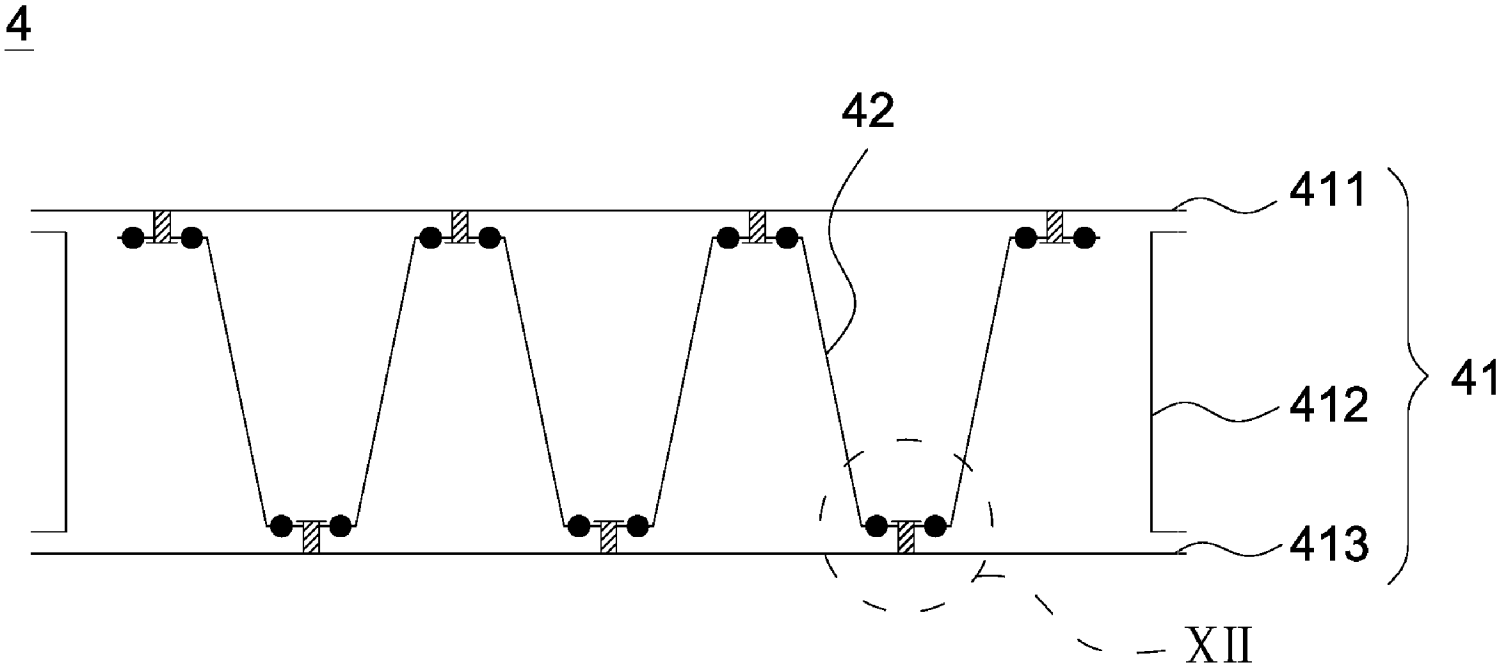
FIG. 11 is a sectional view of an inflatable product in accordance with a fifth embodiment of the invention.
Figure 12:
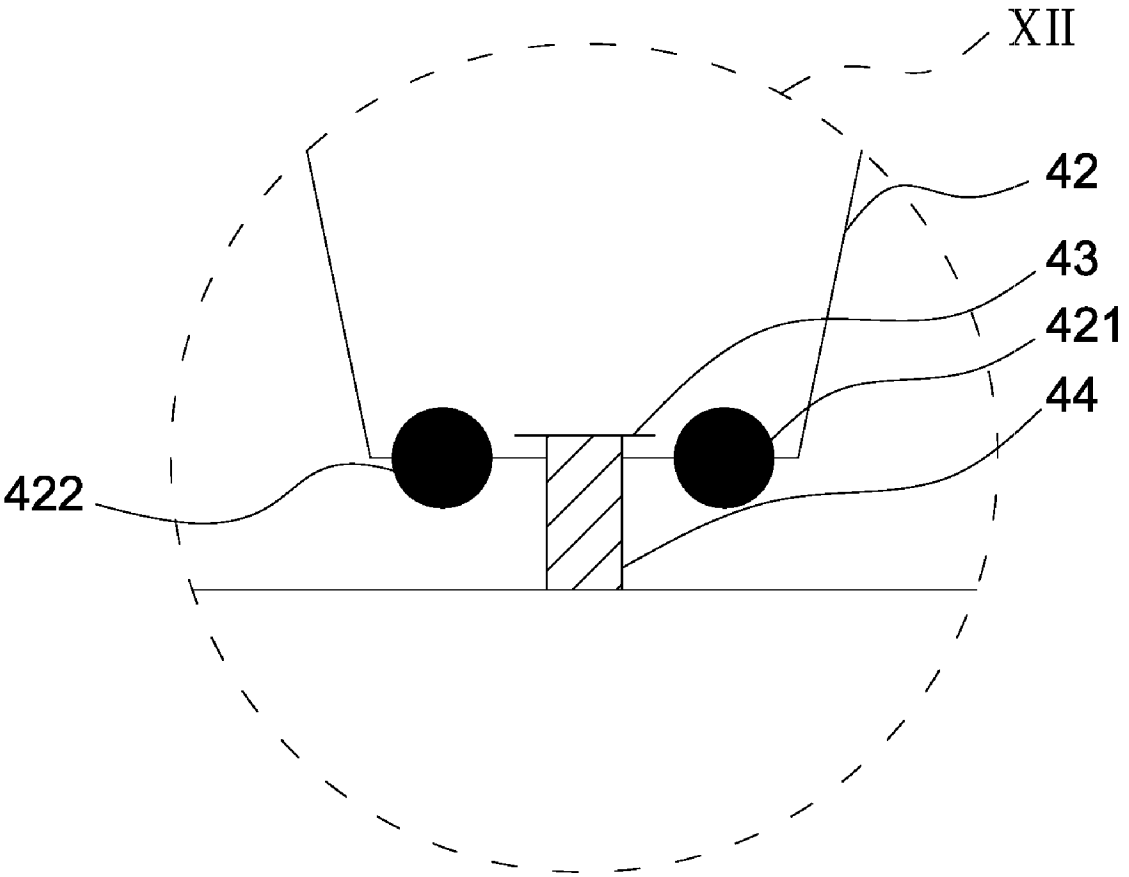
FIG. 12 is a local view of the inflatable product of FIG. 11.

Referring to FIGS. 11 and 12, an inflatable product 4 of a fifth embodiment of the invention includes an inflatable chamber 41, an elongated element 42 and first supplemental sheets 43 disposed in the inflatable chamber 41 and fused with the inflatable chamber 41 to form fusion portions 44. The inflatable chamber 41 includes a top wall 411, a bottom wall 413 and a side wall 412. The elongated element 42 has enlarged portions 421, 422 and is connected to the top wall 411 and the bottom wall 413 with the enlarged portions 421, 422 constrained by the fusion portions 44. The first supplemental sheets 43 are disposed to partially cover the elongated element 42 but not to cover the enlarged portions 421, 422 of the elongated elements 42.

Figure 13:
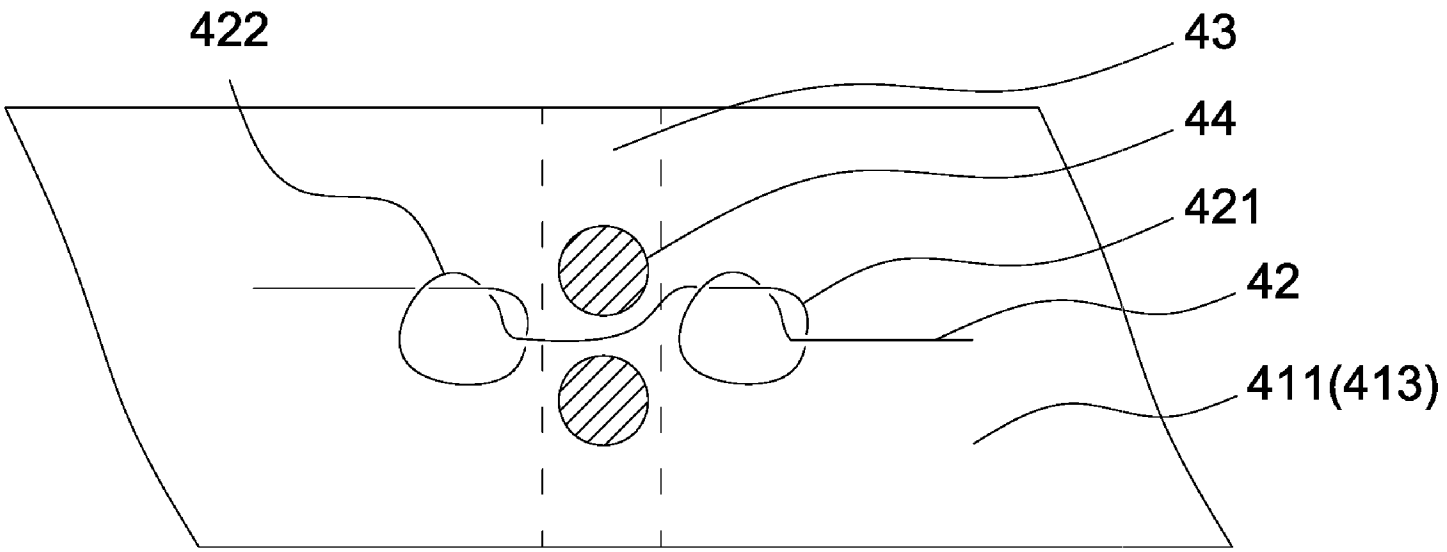
FIG. 13 is a top view of the air mattress of FIG. 12.

The elongated element 42 extends in the inflatable chamber 41 and curves alternately in opposite directions to be wavy. As shown in FIG. 13, the elongated element 42 extends to pass between the fusion portions 44 while the enlarged portions 421, 422 are disposed at opposite sides of the fusion portions 44. When the inflatable chamber 4 is inflated to expand, the elongated element 42 is in tension and the enlarged portions 421, 422 are forced against the fusion portions 44 so as to avoid separation of the elongated element 42 from the inflatable chamber 41.

Figure 15:
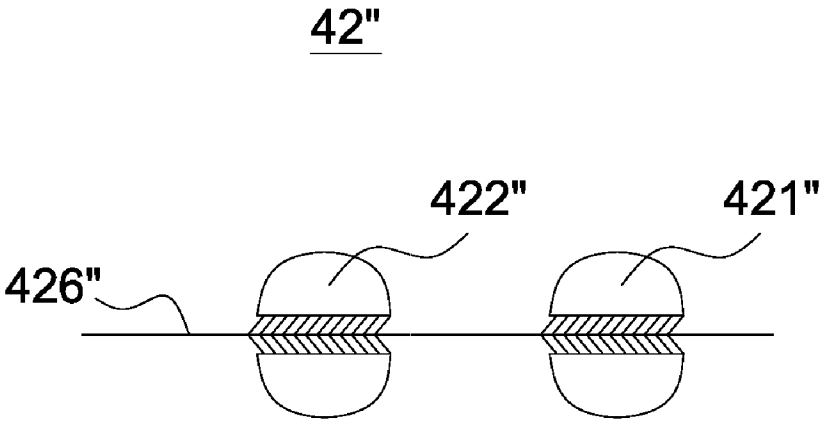
FIG. 15 depicts another modified elongated element of the inflatable product of the fifth embodiment.
Figure 14:
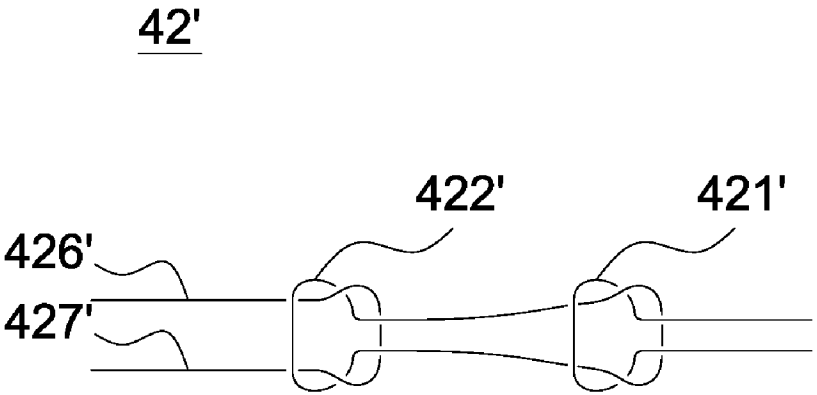
FIG. 14 depicts a modified elongated element of the inflatable product of the fifth embodiment.

The elongated element 42 can be replaced with another elongated element 42' as shown in FIG. 14, wherein the elongated element 42' includes a plurality of cords 426', 427' with knots 421', 422' formed therein. Alternatively, the elongated element 42 can be replaced with another elongated element 42" as shown in FIG. 15, wherein the elongated element 42" includes a cord 426" with lumps or knobs 421", 422" attached thereto.

Figure 16:
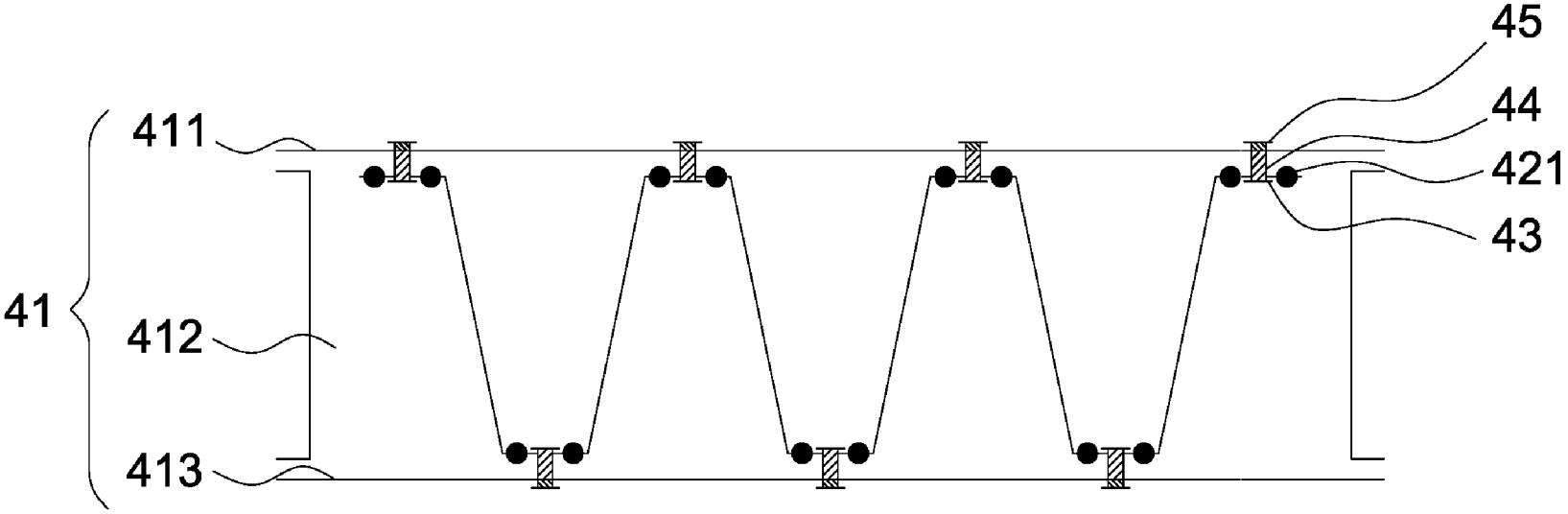
FIG. 16 is a sectional view of an inflatable product in accordance with a sixth embodiment of the invention.

Referring to FIG. 16, in a sixth embodiment, the inflatable product further includes second supplemental sheets 45 disposed outside the inflatable chamber 41 and fused with the inflatable chamber 41 and the first supplemental sheets 43 to enhance the structural strengths of the fusion portions 44. Other structure and arrangements of this embodiment are identical to those of the third embodiment and therefore the descriptions thereof are omitted.

In the sixth embodiment, the second supplemental sheets 45 are disposed outside the inflatable chamber 41. However, the invention is not limited thereto. For example, the second supplemental sheets 45 can be disposed in the inflatable chamber 41 to respectively contact the top wall 411 and the bottom wall 413, wherein the second supplemental sheets 45 are disposed between the first supplemental sheets 43 and the inflatable chamber 41, and the enlarged portions 421 are not covered with the first supplemental sheets 43 and the second supplemental sheets 45. The second supplemental sheets 45 are fused with the inflatable chamber 41 and the first supplemental sheets 43 to enhance the structural strengths of the fusion portions 44.

In the above embodiments, the elongated element(s) is/are connected to the top wall and the bottom wall for controlling expansion of the inflatable chamber. However, the invention is not limited thereto. In some embodiments, the elongated element(s) is/are connected to the top wall (or the bottom wall) and the side wall. Alternatively, the elongated element (s) is/are connected to the top wall, the bottom wall and the side wall.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product, comprising:

an inflatable chamber comprising multiple fusion portions; and an elongated element which is flexible disposed in the inflatable chamber, wherein the elongated element comprises enlarged portions and is connected to the inflatable chamber with the enlarged portions constrained by the fusion portions;

wherein the fusion portions are disposed outside the enlarged portions;

wherein at least two of the fusion portions are spaced apart to define a gap through which the elongated element passes;

wherein the elongated element is in tension for controlling expansion of the inflatable chamber to a desired shape when the inflatable chamber is inflated to expand;

wherein the enlarged portions are constrained by the at least two fusion portions to avoid separation of the elongated element from the inflatable chamber when the inflatable chamber is inflated to expand;

wherein the enlarged portions and fusions portions are arranged such that the enlarged portions are drawn towards and forced against the at least two fusion portions when the inflatable chamber is inflated so that the elongated element is in tension.

2. The inflatable product as claimed in claim 1, wherein the enlarged portions are knots.

3. The inflatable product as claimed in claim 1, wherein the enlarged portions are lumps or knobs in the elongated element.

4. The inflatable product as claimed in claim 1, wherein the enlarged portions are substances extending laterally from the elongated element.

5. The inflatable product as claimed in claim 1, wherein the elongated element extends to pass between the at least two fusion portions while the enlarged portions are disposed between the at least two fusion portions, and the enlarged portions are forced against the at least two fusion portions when the inflatable chamber is inflated so that the elongated element is in tension.

6. The inflatable product as claimed in claim 1, wherein the elongated element extends to pass between the at least two fusion portions while the enlarged portions are disposed beside the at least two fusion portions, and the enlarged portions are forced against the at least two fusion portions when the inflatable chamber is inflated so that the elongated element is in tension.

7. The inflatable product as claimed in claim 1, wherein the elongated element extends to pass between the at least two fusion portions while the enlarged portions are disposed at opposite sides of the at least two fusion portions, and the enlarged portions are forced against the at least two fusion portions when the inflatable chamber is inflated so that the elongated element is in tension.

8. The inflatable product as claimed in claim 1, wherein the inflatable chamber further comprises a top wall, a bottom wall and a side wall connected to the top wall and the bottom wall, and the elongated element is connected to the top wall and the bottom wall.

9. The inflatable product as claimed in claim 1, wherein the inflatable chamber further comprises a top wall, a bottom wall and a side wall connected to the top wall and the bottom wall, and the elongated element is connected to the top wall and the side wall.

10. The inflatable product as claimed in claim 1, wherein the inflatable chamber further comprises a top wall, a bottom wall and a side wall connected to the top wall and the bottom wall, and the elongated element is connected to the bottom wall and the side wall.

11. The inflatable product as claimed in claim 1, wherein the elongated element extends in the inflatable chamber and curves alternately in opposite directions.

12. The inflatable product as claimed in claim 1, further comprising other elongated elements disposed in the inflatable chamber wherein all the elongated elements are arranged in a row or in an array.

13. The inflatable product as claimed in claim 1, further comprising other elongated elements disposed in the inflatable chamber wherein the inflatable chamber further comprises a top wall, a bottom wall and a side wall connected to the top wall and the bottom wall, and all the elongated elements are substantially perpendicular to the top wall and the bottom wall when the inflatable chamber is inflated to expand so that all the elongated elements are in tension.

14. An inflatable product comprising:

an inflatable chamber comprising fusion portions;

an elongated element which is flexible disposed in the inflatable chamber, wherein the elongated element comprises enlarged portions and is connected to the inflatable chamber with the enlarged portions constrained by the fusion portions;

first supplemental sheets disposed in the inflatable chamber and fused with the inflatable chamber to form the fusion portions and to cover the enlarged portions of the elongated element;

second supplemental sheets disposed outside the inflatable chamber and fused with the inflatable chamber and the first supplemental sheets;

wherein the fusion portions are disposed outside the enlarged portions;

wherein the elongated element is in tension for controlling expansion of the inflatable chamber to a desired shape when the inflatable chamber is inflated to expand;

wherein the enlarged portions are constrained by the fusion portions to avoid separation of the elongated element from the inflatable chamber when the inflatable chamber is inflated to expand;

wherein the enlarged portions and fusions portions are arranged such that the enlarged portions are drawn towards and forced against the fusion portions when the inflatable chamber is inflated so that the elongated element is in tension;

wherein the enlarged portions are disposed between the first supplemental sheets and the second supplemental sheets.

15. An inflatable product comprising:

an inflatable chamber comprising fusion portions;

an elongated element which is flexible disposed in the inflatable chamber, wherein the elongated element comprises enlarged portions and is connected to the inflatable chamber with the enlarged portions constrained by the fusion portions;

first supplemental sheets disposed in the inflatable chamber and fused with the inflatable chamber to form the fusion portions and to cover the enlarged portions of the elongated element;

second supplemental sheets disposed in the inflatable chamber and fused with the inflatable chamber and the first supplemental sheets wherein the enlarged portions are disposed between the first supplemental sheets and the second supplemental sheets;

wherein the fusion portions are disposed outside the enlarged portions;

wherein the elongated element is in tension for controlling expansion of the inflatable chamber to a desired shape when the inflatable chamber is inflated to expand;

wherein the enlarged portions are constrained by the fusion portions to avoid separation of the elongated element from the inflatable chamber when the inflatable chamber is inflated to expand;

wherein the enlarged portions and fusions portions are arranged such that the enlarged portions are drawn towards and forced against the fusion portions when the inflatable chamber is inflated so that the elongated element is in tension.

16. An inflatable product, comprising:

an inflatable chamber comprising multiple constraining portions; and an elongated element which is flexible disposed in the inflatable chamber, wherein the elongated element comprises enlarged portions and is connected to the inflatable chamber with the enlarged portions constrained by the constraining portions;

wherein the constraining portions are disposed outside the enlarged portions;

wherein the at least two of constraining portions are spaced apart to define a gap through which the elongated element passes;

wherein the elongated element is in tension for controlling expansion of the inflatable chamber to a desired shape when the inflatable chamber is inflated to expand;

wherein the enlarged portions are constrained by the constraining portions to avoid separation of the elongated element from the inflatable chamber when the inflatable chamber is inflated to expand;

wherein the enlarged portions and constraining portions are arranged such that the enlarged portions are drawn towards and forced against the constraining portions when the inflatable chamber is inflated so that the elongated element is in tension.

17. The inflatable product as claimed in claim 16, further comprising supplemental sheets disposed in the inflatable chamber and fused with the inflatable chamber, wherein the constraining portions are fixed to the supplemental sheets, and the enlarged portions are disposed between the constraining portions and the supplemental sheets.

18. An inflatable product comprising:

an inflatable chamber;

a first supplemental sheet fused with the inflatable chamber;

a second supplemental sheet fused with the first supplemental sheet and/or the inflatable chamber;

a plurality of fusion portions formed by fusing the second supplemental sheet with the first supplemental sheet and/or the inflatable chamber;

an elongated element which is flexible disposed in the inflatable chamber, wherein the elongated element comprises enlarged portions and is connected to the inflatable chamber with the enlarged portions constrained by the fusion portions;

wherein at least two of the fusion portions are spaced apart to define a gap through which the elongated element passes;

wherein the elongated element is in tension for controlling expansion of the inflatable chamber to a desired shape when the inflatable chamber is inflated to expand;

wherein the enlarged portions are constrained by the at least two fusion portions to avoid separation of the elongated element from the inflatable chamber when the inflatable chamber is inflated to expand;

wherein the enlarged portions and fusions portions are arranged such that the enlarged portions are drawn towards and forced against the at least two fusion portions when the inflatable chamber is inflated so that the elongated element is in tension.

19. An inflatable product comprising:

an inflatable chamber comprising at least two fusible sheets;

an elongated element which is flexible disposed in the inflatable chamber;

wherein the elongated element comprises an enlarged portion enclosed by the fusible sheets;

wherein the inflatable chamber has a predetermined location, and the fusible sheets are fused at two sides of the predetermined location to form a gap which allows the elongated element to pass through;

wherein the gap is smaller than the enlarged portion, thereby stopping the enlarged portion from passing through and keeping the enlarged portion in position when the inflatable chamber is inflated and the elongated element is in tension.

* * * * *